US007325354B2

(12) United States Patent
Grauslys et al.

(10) Patent No.: US 7,325,354 B2
(45) Date of Patent: Feb. 5, 2008

(54) WEAPON AIMING DEVICE

(75) Inventors: Richard P. Grauslys, Litchfield, NH (US); Allen R. Harding, Bedford, NH (US)

(73) Assignee: Insight Technology, Inc., Londonderry, NH (US)

( * ) Notice: Subject to any disclaimer, the term of this patent is extended or adjusted under 35 U.S.C. 154(b) by 72 days.

(21) Appl. No.: 11/123,662

(22) Filed: May 6, 2005

(65) Prior Publication Data

US 2007/0214701 A1 Sep. 20, 2007

Related U.S. Application Data

(60) Provisional application No. 60/568,528, filed on May 6, 2004.

(51) Int. Cl.
*F41G 1/38* (2006.01)
*F41G 1/34* (2006.01)

(52) U.S. Cl. ..... 42/131; 42/123

(58) Field of Classification Search ..... 42/114, 42/118, 123, 131
See application file for complete search history.

(56) References Cited

U.S. PATENT DOCUMENTS

| | | | | |
|---|---|---|---|---|
| 3,010,019 | A | 11/1961 | Sohst | |
| 3,656,845 | A | 4/1972 | Koch-Bossard | |
| 4,266,873 | A | 5/1981 | Hacskaylo et al. | |
| 4,279,191 | A | 7/1981 | Johansson | |
| 4,330,706 | A | 5/1982 | Lawenhaupt | |
| 4,402,605 | A * | 9/1983 | Ekstrand | 356/252 |
| 4,417,814 | A | 11/1983 | Doliber | |
| 4,554,744 | A | 11/1985 | Huckenbeck | |
| 4,658,139 | A | 4/1987 | Brennan et al. | |
| 4,665,622 | A | 5/1987 | Idan | |
| 4,712,885 | A * | 12/1987 | Dawson et al. | 359/728 |
| 4,738,044 | A | 4/1988 | Osterhout | |
| 4,804,858 | A | 2/1989 | Jorlov | |
| D312,089 | S | 11/1990 | Jorlov | |
| 4,993,833 | A | 2/1991 | Lorey et al. | |
| RE33,572 | E | 4/1991 | Meyers | |
| 5,040,885 | A | 8/1991 | Simms | |
| 5,052,801 | A | 10/1991 | Downes, Jr. et al. | |
| 5,064,988 | A | 11/1991 | E'nama et al. | |
| 5,090,805 | A | 2/1992 | Stawarz | |
| 5,117,804 | A | 6/1992 | Jorlov | |
| 5,118,186 | A | 6/1992 | Schratzenstaller | |
| 5,189,555 | A | 2/1993 | Jorlov | |
| 5,205,044 | A | 4/1993 | DePaoli | |
| 5,221,956 | A | 6/1993 | Patterson et al. | |
| 5,249,501 | A | 10/1993 | Waldman | |

(Continued)

FOREIGN PATENT DOCUMENTS

WO WO 01/06199 A1 * 1/2001

*Primary Examiner*—Bret Hayes

(57) ABSTRACT

A weapon aiming system may utilize a laser diode and a reflective coating on an optical element to generate a red dot aim point for a shooter with a bright view to the target with minimal color distortion. The optical element may utilize an off-axis parabolic lens to reduce parallax to improve sighting accuracy. The weapon aiming system may utilize visible and infrared aim lasers that are coaligned to simplify boresighting of the weapon and to simplify target acquisition. The weapon aiming system may include a magnifier and a sight being disposed along a longitudinal rail of a weapon in a position with the close quarter combat sight being disposed between the magnifier and the weapon muzzle.

21 Claims, 6 Drawing Sheets

U.S. PATENT DOCUMENTS 5,272,514 A 12/1993 Dor
5,359,779 A 11/1994 Polk
5,374,986 A 12/1994 Solinsky
5,400,540 A 3/1995 Solinsky et al.
5,440,387 A 8/1995 Montelin
5,483,362 A * 1/1996 Tai et al. ..... 359/1
5,577,326 A 11/1996 Montelin
5,901,452 A * 5/1999 Clarkson ..... 42/131
6,190,025 B1 2/2001 Solinsky
6,373,628 B1 * 4/2002 Gunnarsson et al. ..... 359/428
6,490,060 B1 * 12/2002 Tai et al. ..... 359/15
RE38,025 E * 3/2003 Skunes et al. ..... 356/400
6,717,654 B1 * 4/2004 Rajchel et al. ..... 356/4.01
6,807,742 B2 * 10/2004 Schick et al. ..... 33/297
6,899,297 B1 * 5/2005 Sand et al. ..... 244/3.12
7,006,203 B1 * 2/2006 Book et al. ..... 356/5.01
7,068,699 B2 * 6/2006 Nettleton et al. ..... 372/92

* cited by examiner

WEAPON AIMING DEVICE

CROSS-REFERENCE TO RELATED APPLICATIONS

The present application claims the benefit of U.S. provisional patent application Ser. No. 60/568,528, filed May 6, 2004, the disclosure of which is incorporated herein by reference in its entirety.

TECHNICAL FIELD

This invention relates to a weapon-aiming device, and more particularly to a weapon-mountable red dot sight.

BACKGROUND OF THE INVENTION

In close quarter combat, typically in the ranges of 2-800 meters, soldiers are required to rapidly acquire, identify, and accurately fire on enemy targets. Soldiers may use weapon-mounted sights with visible and infrared light sources to assist in the aiming process during daytime and nighttime missions. These sights may be mounted on handheld weapons such as the M4A1 carbine and other small arms and are used to provide better target observation, illumination, and marking.

Traditional weapon-mounted sights utilize red dot sights that incorporate a light emitting diode (LED) as a source of illumination in conjunction with a pinhole aperture. Light emitted from the LED and passing through the pinhole is reflected by an optical element and forms an aim point that can be seen by a shooter looking through the close quarter combat sight. Because the LED has a relatively large emitting area and practical transmission and machining capability limitations limit how small a pinhole can be used, the resulting aim point is relatively large in size. Such a large aim point is undesirable and impairs accuracy especially when aiming at a relatively small target or a target at a relatively long distance.

Red dot sights may be used both during the day without assistance or at night with the assistance of a night vision device such as a monocular or goggle. Red dot sights utilizing tritium (a radioactive isotope) exist, but suffer because the brightness can not be increased during the day and decreased during the night to be compatible with night vision devices.

A dichroic coating is commonly used on a lens surface of a red dot sight to partially reflect or transmit light and to provide a simultaneous view of the red dot and the target scene. Because a visible LED has a relatively weak, apertured light intensity, the optical element typically needs to have a highly reflective coating if a significant amount of the light energy is to be reflected toward the shooter. This highly reflective coating effectively blocks light from the target scene in transmission at wavelengths similar to those being reflected from the LED. Therefore if the a red dot sight employs a red LED, the optical element commonly has a coating that reflects a relatively high percentage of the red light energy from the LED to increase the brightness of the LED visible to the eye, and thus also blocks a high percentage of red light from the target scene. The result is the target scene has an undesirable blue tint. Not only does this blue tint cause the scene to look unnatural, it also impairs one's ability to use the sight with two eyes open because one eye sees the target scene in normal color while the eye seeing the target scene through the sight sees a bluish scene. The blue tint also makes target acquisition difficult in low light conditions such as dusk or dawn because a lack of light transmission. Depending on the nature of the reflective coating, the coating impairs the transmission of light in a portion of the electromagnetic spectrum that the night vision device is sensitive thereby reducing the performance capabilities of the night vision device, in turn affecting the ability of the operator to detect and direct fire on the target. This can be quite distracting. The large aim point and the distorted color of the target scene are two major limitations of existing red dot sights.

Traditional red dot sights have optical elements having spherical optical elements or in some cases holographic elements. With such elements, parallax is present to a significant degree. That is, as the observer looking through the red dot sight moves his eye relative to the sight optical aperture, the point of aim moves with respect to the target. This results in a loss of aiming accuracy. Also, since different shooters hold their eye differently relative to the sight, no single boresight or zero setting of the sight is suitable for all users. This means that each shooter may need to boresight or zero the red dot sight for himself.

BRIEF SUMMARY OF THE INVENTION

A weapon mountable sight has a housing configured to be coupleable to a weapon, where the housing houses a laser diode for a light source and a reflective element to reflect light emitted from the laser diode towards a user looking through the housing.

A close quarter combat sight has a housing, where the housing houses a source of light and a parabolic element. The parabolic element having a reflective coating capable of reflecting light in a narrow band within the visible passband, with a transmission of 10%-40% relative intensity.

A weapon aiming system has a weapon with rails along at least a portion of a longitudinal axis between a butt and a muzzle, a magnifier, and a close quarter combat sight. The close quarter combat sight being disposed along the rail in a position between the magnifier and the muzzle.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
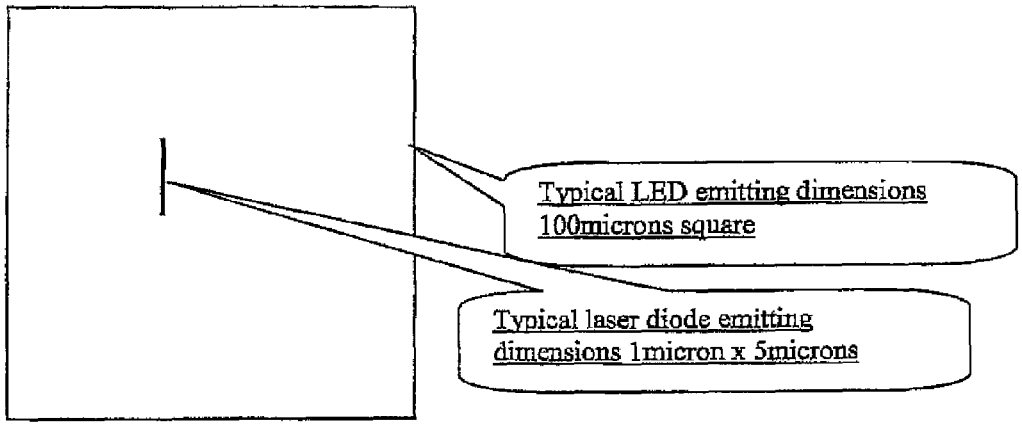
FIG. 1 is a relative comparison of the emitting dimensions of an LED versus a laser diode.

FIG. 1 is a relative comparison of the emitting dimensions of a light emitting diode (LED) versus a laser diode. A typical LED has an emitting dimension of 100 microns square or larger whereas a typical laser diode has an emitting dimension of 1 micron×5 microns. When using an LED in a close quarter combat optics, for example a red dot sight, a light blocking plate with an aperture is placed in front of the LED to reduce the size of the exiting light beam. The aperture size is approximately 0.0005" to 0.002" in diameter. The aperture is typically formed in the plate, as a secondary step after molding or machining, with a laser due to the small aperture size requirement. The plate with this secondary step can add significant cost to the sight. The light emitted from the LED that is blocked by the plate (>95%) is trapped inside the optics housing and adds heat within the enclosure and wastes energy and battery or electric source life. Close quarter combat sights are run off of batteries and this wasted light can greatly reduce the overall battery life.

By using a laser diode as the light source in a close quarter combat optic, the emitting area is reduced to a fraction of the size of an LED. As can be seen in FIG. 1 this smaller emitting area enables the sight to have a smaller and therefore more precise aiming point. The smaller emitting area can also eliminate the need for a blocking plate with an aperture. Due to the more efficient use of light within the optics housing, the laser diode can be driven with less power, which can result in improved battery life.

In addition, by using a laser diode, the light energy is intense, concentrated, and is essentially monochromatic. This means the reflective coating on the optical element can be a relatively low reflectance coating and still allow for an easily observable dot in the brightest environments. Such narrow band reflective coating reflects a small portion of the light emitted by the laser diode, but because of the low reflectance, blocks only a small percentage of light from the target scene. This results in the target scene retaining its natural color. This in turn results in a brighter and more natural looking scene. This also facilitates using the close quarter combat optic with two eyes open since both eyes see the same scene in terms of brightness, color, and all other scene attributes.

Figure 2:
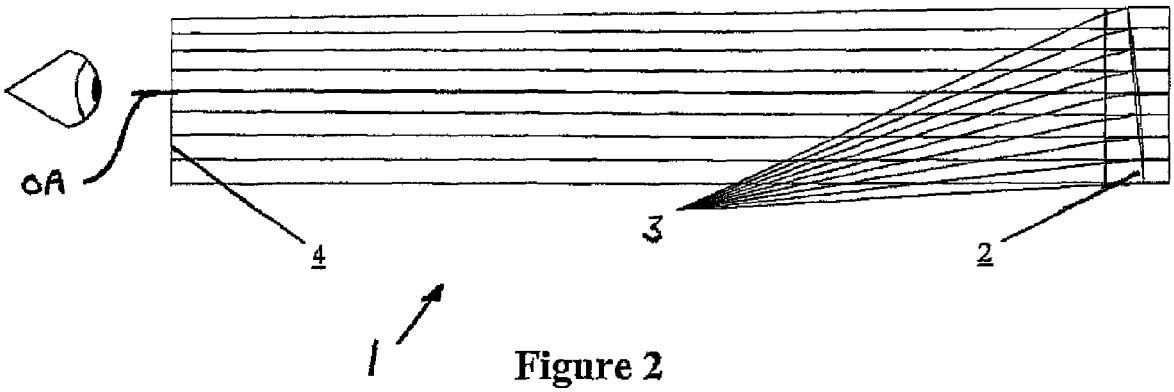
Figure 2 PRIOR ART
FIG. 2 is a profile view of a red dot sight with an LED light source and a spherical optical element.
Figure 3:
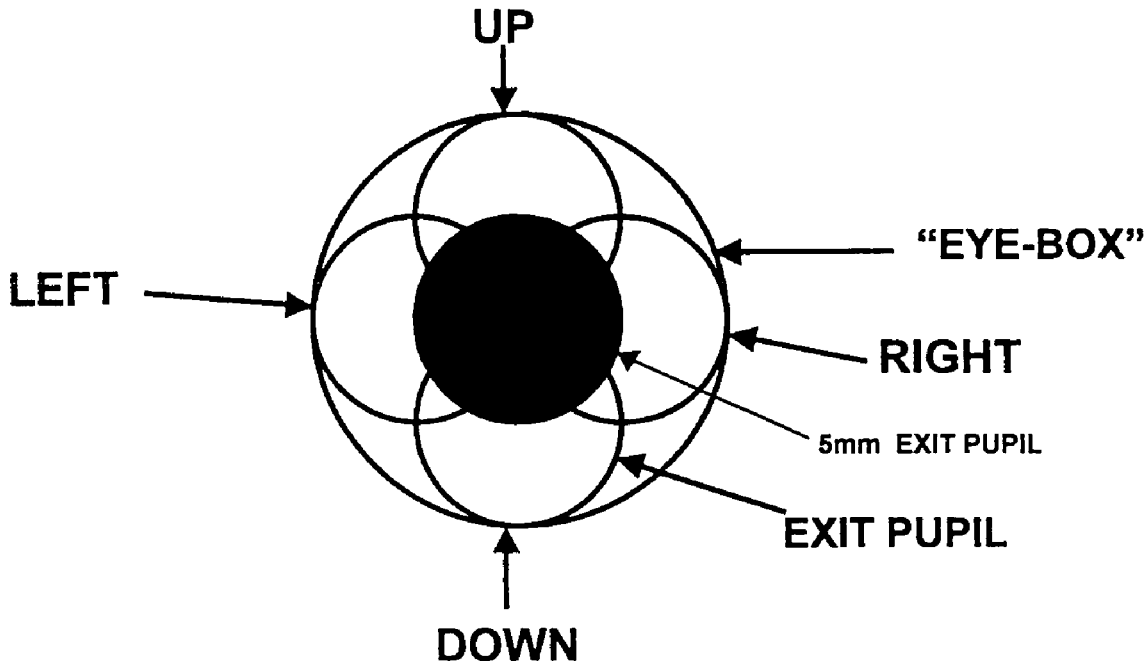
FIG. 3 is an eyepiece eye-box diagram.

FIG. 2 is a profile view of a red dot sight with an LED light source and a spherical optical element. The LED 3 is mounted off of an optical axis OA of the red dot sight 1. It should be noted that as rays from an LED light source 3 are reflected by the spherical optical element 2 they form a ray pattern at a viewing plane 4. The rays within the pattern are not exactly parallel at the viewing plane, and the angle of the ray to the observer's eye is dependent upon the exact position in the plane where the bundle is sampled. This is shown in FIG. 3 where the exit pupil (solid circle) position can be moved left, right, up, and down (clear circle), and still stay within the eye-box. The transmitted rays through the spherical optical element from a very distant target are nearly perfectly parallel, and the difference in angle between rays from the target and rays from the LED light source appear as a physical separation between the target and the image of the source. Thus, the point at which the aiming dot appears on the target is dependent on the shooter's eye position relative to the red dot sight.

Figure 4:
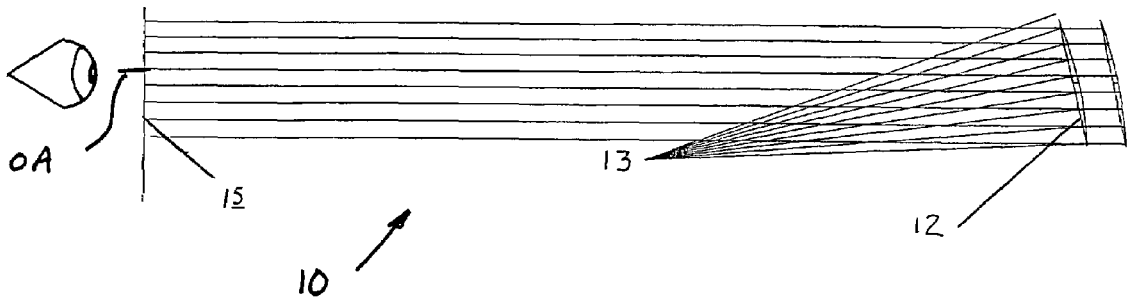
FIG. 4 is a profile view of a red dot sight with a laser diode light source and a parabolic lens consistent with the invention.

FIG. 4 is a profile view of a red dot sight with a laser diode light source 13 and a parabolic lens 12 consistent with the invention. The laser diode light source 13 is mounted off of an optical axis OA of the red dot sight 10. Although reference is made to a red dot sight, other color sights, for example green, are considered within the invention. By incorporating a parabolic lens 12 as the optical element off of which the aiming dot is reflected, parallax can be reduced to a negligible amount at close in ranges and less than 0.25 milliradians at ranges beyond 200 meters. It should be noted that as rays from a laser diode light source 13 are reflected by the parabolic optical element 12 they form a ray pattern at a viewing plane 15. Reduced parallax enables a red dot sight containing the present advanced optical element to be boresighted or zeroed once and effectively used by virtually all shooters to accurately direct weapon fire. It also ensures that a shooter can be highly accurate without having to maintain a consistent eye position or cheek weld relative to the sight or weapon. The result is quicker engagement times, more accurate shooting, and the ability to readily transfer one weapon among several individuals. The parabolic lens may be sealed within the housing to keep it sheltered from the elements (closed sight configuration) or may be exposed to the elements (open sight configuration).

Figure 5:
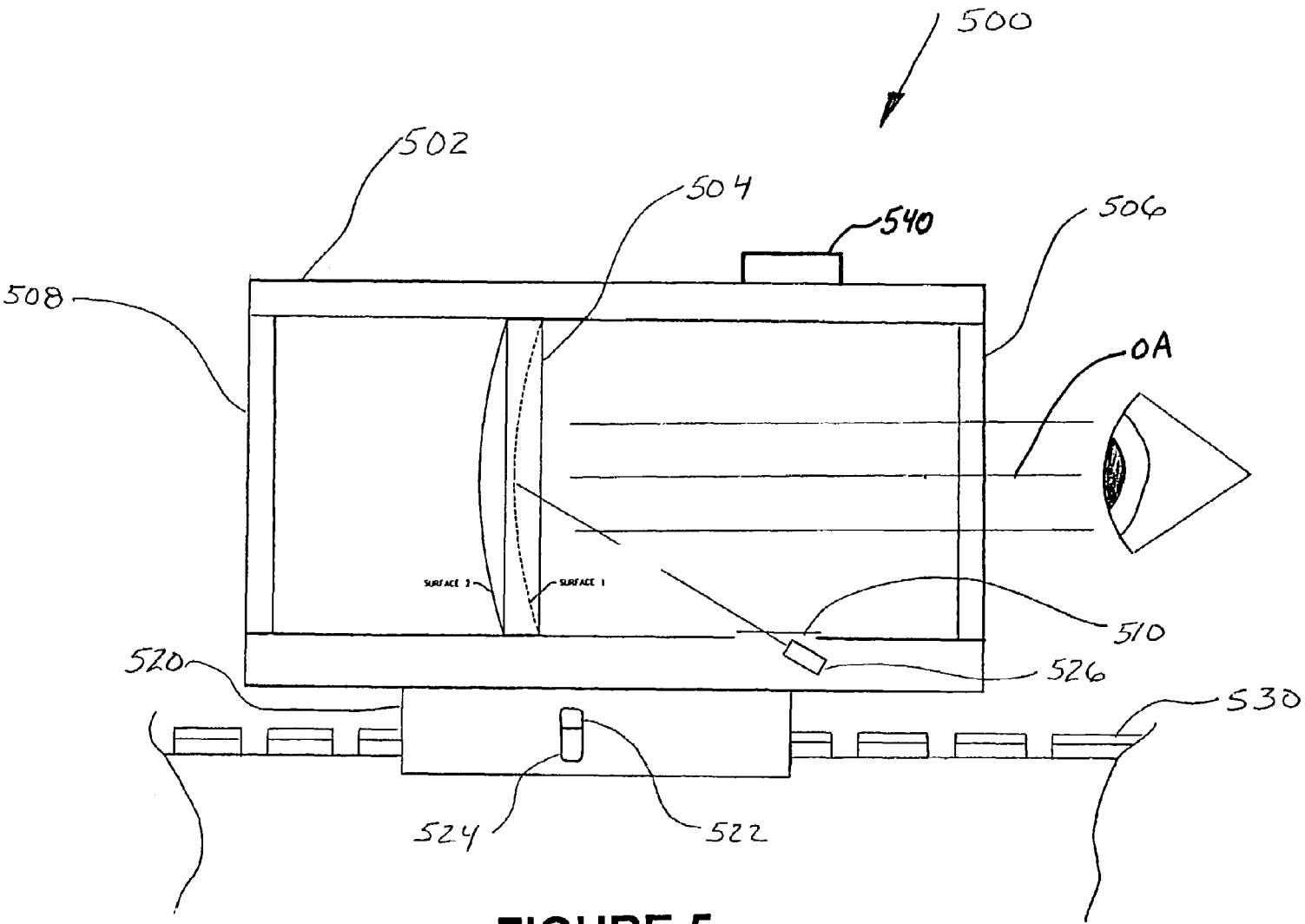
FIG. 5 is a profile view of a red dot sight with an optical element consistent with the invention.

FIG. 5 is a profile view of a red dot sight 500 with an optical element 504 consistent with the invention. Surfaces 1 and 2 of the optical element 504 generally conform to a parabola and the dimensions of the parabola and the thickness of the optical element may be selected by a person of ordinary skill in the art to suit the desired size constraints. The formula for surfaces 1 and 2 respectively may be:

$$Z = \frac{cr^2}{1 + \sqrt{1 - (1+k)c^2r^2}}$$

$$Z = \frac{cr^2}{1 + \sqrt{1 - (1+k)c^2r^2}} + A_1r^2 + A_2r^4$$

(where: r=radial position on lens surface
c=surface curvature (=1/radius)
k=conic constant
A1, A2=aspheric coefficients The material may be glass or plastic, for example optical grade Xeonex E48R. The optical element 504 may be retained in a housing 502. The housing 502 houses a laser diode 526 that is mounted off-axis from the optical axis OA of the housing 502. The housing 502 may incorporate a mechanism 520 for mounting the red dot sight 500 to a weapon 530, for example a handgun or long gun. The mechanism 520 may have a moveable actuator 522 that travels in an opening 524 for connection to and disconnection from the weapon 530. The red dot sight 500 may be mounted to a weapon using a variety of mounting mechanism, including those disclosed in more detail in U.S. Pat. No. 5,430,967, titled, Aiming Assistance Device for a Weapon, issued on Jul. 11, 1995; U.S. Pat. No. 6,574,901, titled, Auxiliary Device for a Weapon and Attachment Thereof, issued Jun. 10, 2003; and U.S. Pat. No. 6,705,038, titled, Mounting Assembly for a Weapon, issued on Mar. 16, 2004, all of which are incorporated herein by reference in their entirety. Additionally, the auxiliary device may utilize a mounting mechanism compatible with a mounting rail disclosed in military specifications (e.g., MIL-STD-1913), a "rail grabber" mounting mechanism, screws, bolts, and/or the like. In a closed sight configuration, the optical element 504 may be disposed within the housing 502 between an objective window 508 and an eyepiece window 506. The objective window 508 and the eyepiece window 506 may protect the optical element 504 from the environment, for example water and sand. In an open sight configuration, one or more of the objective window 508 and the eyepiece window 506 may not be included. In this configuration the optical element 504 may be exposed to the environment and the laser diode 526 may be protected by a cover 510. A power setting actuator 540 coupled to a power control circuit allows a user to control the brightness of the red dot.

Figure 6:
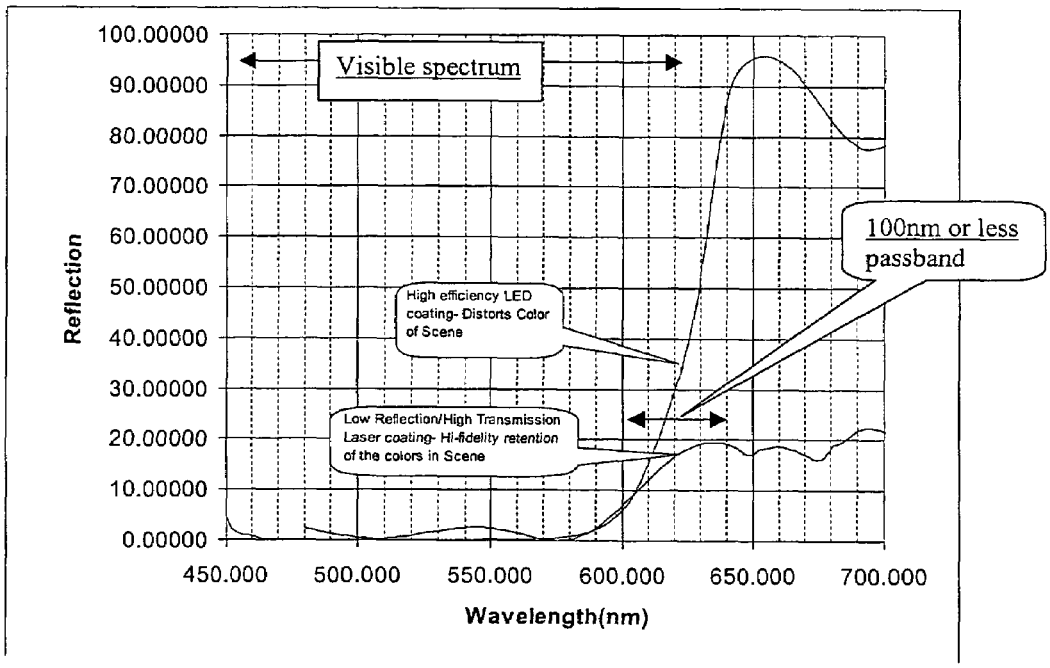
FIG. 6 is a plot of reflection versus wavelength comparing a coating transmission spectrum for an LED coating and a laser coating.

FIG. 6 is a plot of reflection versus wavelength in nanometers comparing a coating transmission spectrum for an LED coating and a laser coating consistent with the invention. The laser coating is selected such that there is a hi-fidelity retention of colors in the scene when a viewer looks through the red dot sight. A coating for surface 1 consistent with the invention has reflectance between about 10% and 50%, preferably between about 10% and 40%, more preferably 20±5% at 650 nm and 11 degree angle of incidence and an average photophic transmission greater than 75%, more preferably about 90% at 11 degrees, preferably ±6 degree angle, more preferably ±3 degree angle of incidence to surface normal. The coated optics in transmission preferably should not shift the apparent CIE 1976 white source by more than 0.06 in (U,V) coordinate radius. A coating for surface 2 consistent with the invention preferably has 0.25% reflectance at 650 nm at an 11 degree angle of incidence. As shown in FIG. 6, the coating consistent with the invention has a greater retention of color of the scene (around 650 nm) when looking through the red dot sight than the LED coating. This results in the scene coloring being more realistic.

As shown in FIG. 6, the reflective element reflects light in a narrow band (less than 100 nm) within the visible passband, with the transmission band as measured at the 10%-40% relative intensity points.

The coating disclosed above is for use with a red light source, which has a wavelength of about 650 nm. If a different color light source were used, for example a green light source, which has a wavelength of about 510 nm, the coating requirement would shift to about 510 nm.

The transmission and reflectance sums to 100% in a non-absorbing coating. The coating described in FIG. 6 has a low averaged reflectance in the visible waveband from 450 nm to 680 nm. This low average visible reflectance corresponds to a high transmittance from the target to the observer.

Figure 7:
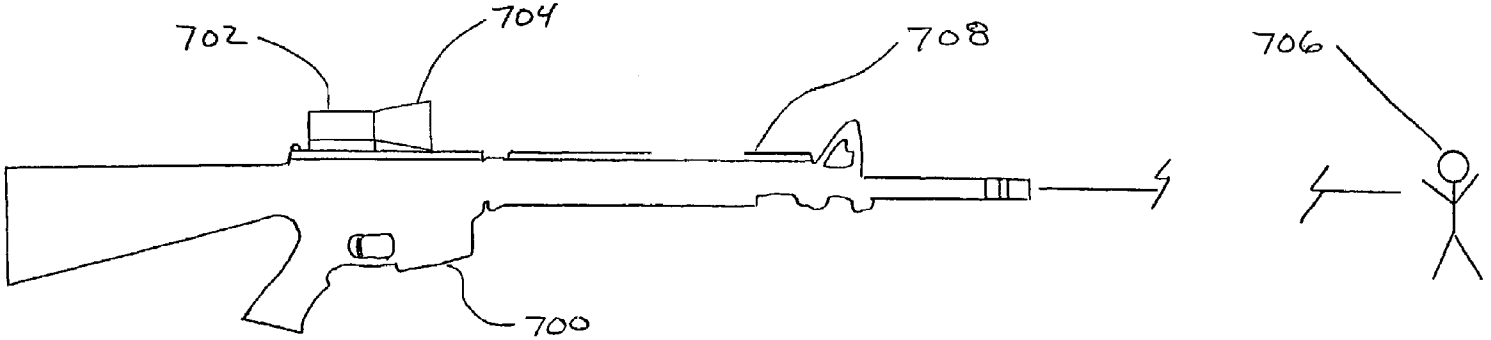
FIG. 7 is a profile view of a weapon with a close quarter combat sight and magnifier.

FIG. 7 is a profile view of a weapon 700 with a close quarter combat sight 702 and magnifier 704. The close quarter combat sight 702 may be mounted to rails 708 on the weapon 700 and the magnifier 704 may mount directly to the close quarter combat sight 702 by screw threads or bayonet mounting. In close quarter combat, the target 706 may be from 2-800 meters away and a soldier needs to clearly see the target 706 throughout this range. Close quarter combat sights typically do not have any magnification capabilities and require the addition of a removeable magnifier to better see longer distance targets. The magnifier is removeable because at shorter distances a magnifier is unnecessary, but at longer distances a magnifier may help the soldier more easily acquire and identify a target. As shown, the magnifier 704 is positioned between the close quarter combat sight 702 and the target 706.

Placement of the magnifier 704 between the close quarter combat sight 702 and the target 706 has drawbacks due to magnification and manufacturing tolerances. Magnifiers have one or more lenses that make the target appear larger. These lenses are typically machined and often have undesired imperfections that may cause the aim point to shift when a magnifier is placed in front of the close quarter combat sight. This shift in aimpoint requires a soldier to either boresight the weapon once without the magnifier and once again with the magnifier or to mentally compensate for the difference in the heat of battle. In addition, if the soldier uses a different magnifier, he will have to reboresight the weapon because of different anomalies in the second magnifier or different rotational alignment of the magnifier to the red dot sight. Another problem with placing the magnifier 704 between the close quarter combat sight 702 and the target 706 is that the magnifier 704 needs to be larger and longer as the required size scales with increasing distance from the eye piece.

Figure 8:
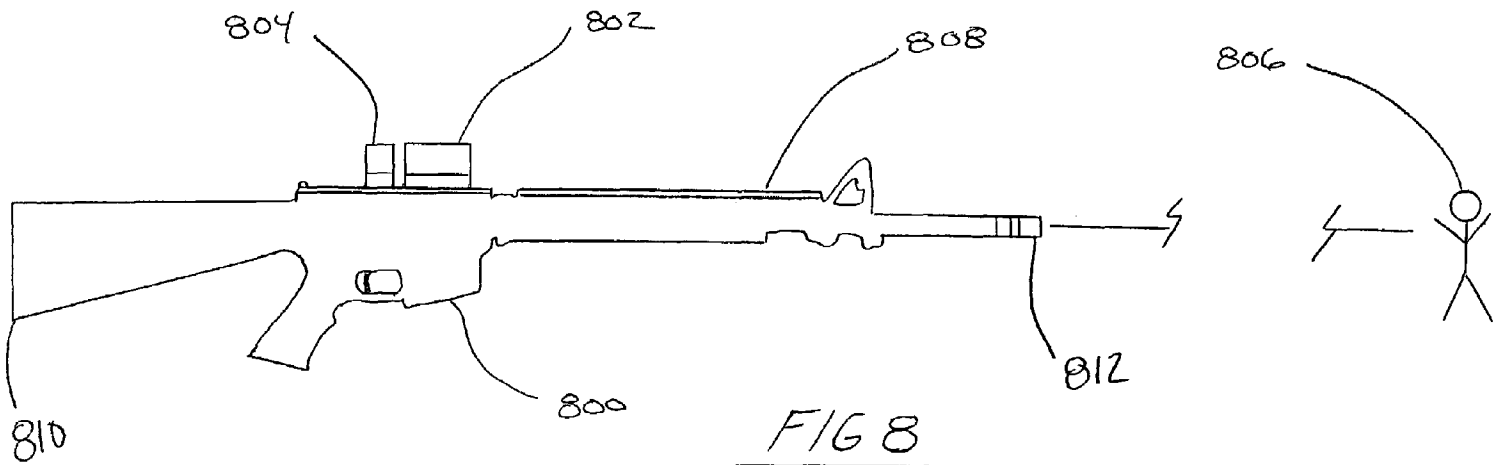
FIG. 8 is a profile view of a weapon with a close quarter combat sight and magnifier consistent with the invention.

FIG. 8 is a profile view of a weapon 800 with a close quarter combat sight 802 and magnifier 804 consistent with the invention. The magnifier 804 is disposed between a soldier (not shown) and the close quarter combat sight 802. The close quarter combat sight 802 may be consistent with the sight disclosed in FIGS. 4, 5, and 6. This mounting arrangement allows the soldier to boresight the weapon once for use with and without the magnifier. The close quarter combat sight 802 may be mountable to rails 808 that extend along at least a portion of a longitudinal axis of the weapon 800 between a butt 810 and a muzzle 812. The magnifier 804 may mount directly to the rails 808 as described above with reference to FIG. 5 or may be coupleable to the rear end of the close quarter combat sight 802, for example by screw threads or bayonet mounting. The magnifier 804 and the close quarter combat sight 802 may be mounted in a variety of locations along the longitudinal axis of the weapon 800 as desired by the soldier.

Figure 9:
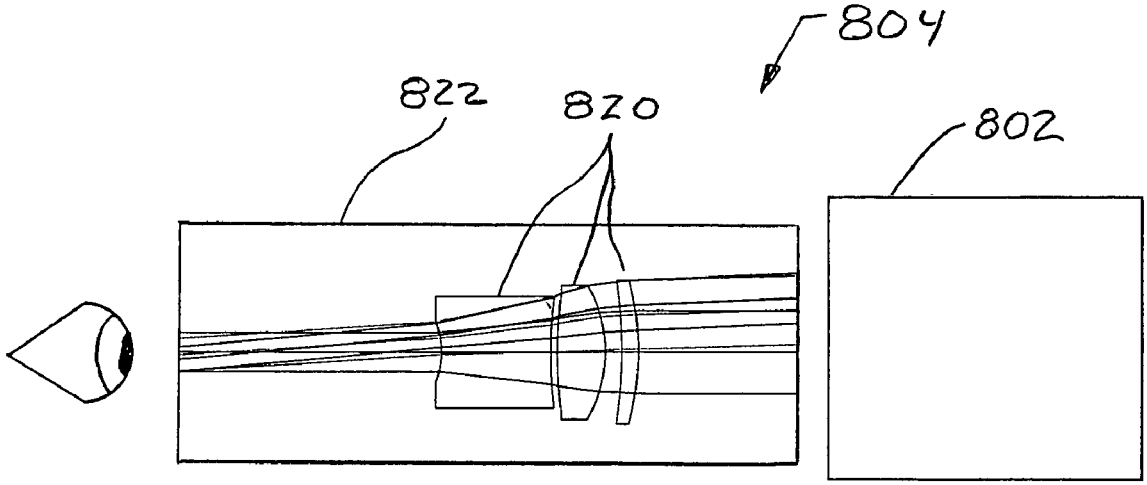
FIG. 9 is a profile view of a magnifier consistent with the invention.

FIG. 9 is a profile view of a magnifier consistent with the invention. The magnifier 804 may have a magnification of 2 or greater, preferably 3-5×. The magnifier 804 has one or more lenses 820 that are housed in a housing 822. One or more of the lenses 820 in the magnifier 804 may be moveable relative to housing 822 or one of the other lenses 820 to allow the soldier to adjust the magnification.

Although reference is made to a soldier, the present invention has applications outside of military applications.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to, be limited thereby.

What is claimed:

1. A weapon mountable sight, comprising:

a housing configured to be coupleable to a weapon;

a laser diode configured to generate a dot, the laser diode having a principal wavelength; and an optical element having a parabolically shaped first surface having a relatively low reflectance coating at an 11 degree angle of incidence around the principal wavelength, the optical element mounted in the housing to allow a user to look therethrough to provide a simultaneous view of the dot and a target scene, wherein the first surface of the optical element generally conforms to a parabola having a formula:

$$z = \frac{cr^2}{1 + \sqrt{1 - (1 + k)c^2r^2}}$$

(where: r=radial position on lens surface
c=surface curvature (=1/radius)
k=conic constant.

2. The weapon mountable sight of claim 1, wherein the first surface reflects between 10% and 30% of the incident light at an 11 degree angle of incidence around the principal wavelength.

3. The weapon mountable sight of claim 2, wherein the first surface reflects between 15%-25% of incident light at an 11 degree angle of incidence around the principal wavelength.

4. The weapon mountable sight of claim 1, wherein the weapon mountable sight is a closed sight configuration.

5. The weapon mountable sight of claim 1, wherein a second and opposing surface of the optical element generally conforms to a parabola having a formula:

$$z = \frac{cr^2}{1 + \sqrt{1 - (1 + k)c^2r^2}} + A_1r^2 + A_2r^4$$

(where: r=radial position on lens surface
c=surface curvature (=1/radius)
k=conic constant
A1, A2=aspheric coefficients.

6. The weapon mountable sight of claim 1, wherein the principal wavelength is about 650 nm.

7. The weapon mountable sight of claim 1, wherein the principal wavelength is about 510 nm.

8. The weapon mountable sight of claim 1, wherein the optical element is a single molded element.

9. The weapon mountable sight of claim 1, wherein the laser diode is disposed on a side of the optical element closest to the user.

10. A close quarter combat sight, comprising:

a housing;

a source of light capable of generating a dot, wherein the source of light is a laser diode;

a parabolic element positioned within the housing to allow a user to look therethrough to provide a simultaneous view of the dot and a target scene; and a reflective coating on a first surface of said parabolic element capable of reflecting light from the source of light towards a user, wherein the reflective coating is configured to reflect less than 30% of incident light at an 11 degree angle of incidence within 50 nm of a principal wavelength of the laser diode.

11. The close quarter combat sight of claim 10, wherein the source of light is spaced from an optical axis of the housing and the parabolic element is within the housing between two optical elements.

12. The close quarter combat sight of claim 10, further comprising a cover over the source of light so that water cannot contact the light source.

13. The close quarter combat sight of claim 10, wherein the laser diode has a principal wavelength about 650 nm.

14. The close quarter combat sight of claim 10, wherein the parabolic element has a second surface with an anti-reflective coating of 0.25% reflectance about 650 nm at an 11 degree angle of incidence.

15. The close quarter combat sight of claim 10, wherein the source of light is disposed on a side of the parabolic element closest to the user.

16. A weapon mountable sight, comprising:

a housing configured to be coupleable to a weapon;

a laser diode configured to generate a dot, the laser diode having a principal wavelength; and an optical element having a parabolically shaped first surface having a relatively low reflectance coating at an 11 degree angle of incidence around the principal wavelength, the optical element mounted in the housing to allow a user to look therethrough to provide a simultaneous view of the dot and a target scene, wherein a second surface of the optical element generally conforms to a parabola having a formula:

$$z = \frac{cr^2}{1 + \sqrt{1 - (1 + k)c^2r^2}} + A_1r^2 + A_2r^4$$

(where: r=radial position on lens surface
c=surface curvature (=1/radius)
k=conic constant
A1, A2=aspheric coefficients.

17. The weapon mountable sight of claim 16, wherein the first surface reflects between 10% and 30% of incident light at an 11 degree angle of incidence around the principal wavelength.

18. The weapon mountable sight of claim 17, wherein the first surface reflects between 15%-25% of incident light at an 11 degree angle of incidence around the principal wavelength.

19. The weapon mountable sight of claim 16, wherein the weapon mountable sight is a closed sight configuration.

20. A weapon mountable sight, comprising:

a housing configured to be coupleable to a weapon;

a laser diode configured to generate a dot, the laser diode having a principal wavelength; and an optical element having a parabolically shaped first surface having a relatively low reflectance coating at an 11 degree angle of incidence around the principal wavelength, the optical element mounted in the housing to allow a user to look therethrough to provide a simultaneous view of the dot and a target scene, wherein the optical element has a parabolically shaped second surface having an anti-reflective coating of 0.25% reflectance around the principal wavelength.

21. A close quarter combat sight, comprising:

a housing;

a source of light capable of generating a dot;

a parabolic element positioned within the housing to allow a user to look therethrough to provide a simultaneous view of the dot and a target scene; and a reflective coating on a first surface of said parabolic element capable of reflecting light from the source of light towards a user, wherein the parabolic element has a second surface with an anti-reflective coating of 0.25% reflectance about 650 nm at an 11 degree angle of incidence.

* * * * *